US008503710B1

(12) United States Patent
Meyberg et al.

(10) Patent No.: US 8,503,710 B1
(45) Date of Patent: Aug. 6, 2013

(54) HEADSET WITH ROTATABLE EARPIECE

(75) Inventors: Jacob Meyberg, Santa Cruz, CA (US); Ruperto Navarro, Tijuana (MX); Alan W Grattan, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1738 days.

(21) Appl. No.: 11/809,554

(22) Filed: Jun. 1, 2007

(51) Int. Cl.
*H04R 25/00* (2006.01)

(52) U.S. Cl.
USPC ..... 381/370

(58) Field of Classification Search
USPC ..... 381/370, 371, 374
See application file for complete search history.

(56) References Cited

U.S. PATENT DOCUMENTS

| | | | | |
|---|---|---|---|---|
| 5,469,505 | A * | 11/1995 | Gattey et al. | 379/430 |
| 5,715,321 | A * | 2/1998 | Andrea et al. | 381/92 |
| 6,154,539 | A * | 11/2000 | Pitel | 379/430 |
| 6,724,906 | B2 * | 4/2004 | Naksen et al. | 381/379 |
| 6,775,390 | B1 * | 8/2004 | Schmidt et al. | 381/371 |
| 6,970,572 | B2 * | 11/2005 | Murozaki et al. | 381/381 |
| 6,980,666 | B1 * | 12/2005 | Owen | 381/371 |
| 7,570,777 | B1 * | 8/2009 | Taenzer et al. | 381/381 |
| 2008/0132292 | A1 * | 6/2008 | Hansen et al. | 455/569.1 |
| 2008/0170738 | A1 * | 7/2008 | Hope et al. | 381/371 |

* cited by examiner

*Primary Examiner* — Jeffrey Donels

(57) ABSTRACT

A sound delivery device is provided which includes a headband having a first end and a second end, and an earpiece and a speaker are mounted adjacent the first end of the headband. The earpiece is constructed and arranged to be rotatable with respect to the speaker to optimize comfort, fit, and performance. The earpiece can include a cylindrical section constructed and arranged to cooperate with a spherical section of a joint, and arranged to be rotatable with respect to the joint.

15 Claims, 5 Drawing Sheets

HEADSET WITH ROTATABLE EARPIECE

FIELD OF THE INVENTION

The present invention relates generally to the field of headsets such as those used for communications and headphones for sound delivery to a user.

BACKGROUND OF THE INVENTION

Many different types of sound delivery devices have been used to position and stabilize an audio transducer or speaker adjacent to a user's ear or ears to deliver audio communication to the user. Most commonly, these sound delivery devices comprise either headsets, which allow two-way communications or headphones, which are used for listening to music and other audible waveforms. The terms "headset" and "headphone" will be collectively referred to below as a "headset," in order to simplify the discussion that follows, but with the understanding that description applies to either a "headset" or a "headphone".

Some types of headsets include an ear cushion or similar structure located adjacent the speaker and the user's ear. With these types of headsets, it is important that the ear cushion(s) be positioned next to the plane of the wearer's ear(s) when the headset is being worn, in order to provide a good acoustic seal with the user's ear(s) and provide comfort. Unfortunately, because the size and shape of users' heads vary widely, the ear cushion(s) of a headset can often be positioned improperly relative to the user's head and ear(s). This is a widely acknowledged problem, and many solutions have been proposed over the years to address it. One proposed solution to the problem is disclosed in U.S. Pat. No. 5,469,505 to Gattey et al., entitled "Communications Headset Having a Ball Joint-Mounted Receiver Assembly".

FIGS. 1-2A are drawings of the headset 10 disclosed in the Gattey et al. patent. The headset 10 includes a generally U-shaped, resilient head band 11, which can be fitted over the top of the user's head, and a housing 12 attached to one end of the head band 11. The headset 10 also includes a receiver assembly 13, including a speaker 16 connected to the housing 12 which can be positioned over one of the user's ears, and a microphone boom 14 having a microphone 15 located in its distal end, which can be positioned adjacent the user's mouth. The resilience of the head band 12 biases the receiver assembly 13 against the user's ear. The headset 10 also includes means for rotating and pivoting the receiver assembly 13 with respect to the housing 12.

The receiver assembly 13 is pivotally attached to the housing 12, by way of a ball and socket type spherical joint 17. The housing 12 has a spherical recess 18 molded into its surface facing the inside of headband 11. A speaker shell 19 has a spherical portion 20 for insertion into the spherical recess 18, and is pivotally and rotationally retained by the housing 12. In operation, limited spherical and rotational movement is permitted between speaker shell 19 and housing 12. Speaker wires 22 electrically connect the speaker 16 to circuitry (not shown) in the housing 12 by passing through a hollow stem 23.

While the Gattey et al. patent indicates that the means for rotating and pivoting the receiver assembly 13 provides improved acoustic coupling to the ear and improved comfort for any size or shape of ear, there are certain disadvantages with this proposed solution. First, it should be understood that when the receiver assembly 13 moves relative to the housing 12, the speaker wires 22 can flex and may rub against portions of the device such as the hollow stem 23. Over time such flexing and rubbing can damage the wires 22. Second, the ball and socket type spherical joint 17 can become loose over time. Third, the ball and socket type spherical joint 17 and hollow stem 23 increase the size of the headset, but decreasing the size of the ball and socket type spherical joint 17 and hollow stem 23 can decrease the stability and robustness of the system.

Considering the foregoing problems and limitations of the prior art, it would be desirable to have a headset that can accommodate a variety of shapes and sizes of users' ears and heads, while also providing improved durability and longevity.

BRIEF SUMMARY OF THE INVENTION

Sound delivery devices (e.g., headsets or headphones) with rotatable earpieces are disclosed. An exemplary headset includes a boom which has a microphone connected in one end and at the opposite end of the boom a joint is connected. The outside of the joint includes a first rib, which extends around the upper periphery of the joint, and a second rib, which extends around the joint and is spaced apart from the first rib. The external surface of the joint between the first rib and the second rib is shaped in the form of a section of a sphere. Inside the joint a conventional speaker assembly is mounted.

An earpiece is mounted to the joint, and the earpiece includes a cylindrical section which surrounds a portion of the joint. The earpiece may also include a flange mounted to one side of the cylindrical section, and an earpiece rib is located around the periphery of the bottom of the cylindrical section. An ear cushion can be mounted to the flange. The earpiece and ear cushion may be the same part.

When a user places the headset on his or her head the ear cushion abuts the side of the user's head and the user's ear. The earpiece can rotate to a variety of orientations with respect to the joint so that the earpiece will assume an appropriate orientation relative to the user's head.

BRIEF DESCRIPTION OF THE DRAWINGS

FIG. 2 is a sectional drawing of a portion of the conventional headset in

FIG. 1;

FIG. 2A is another sectional drawing of a portion of the conventional headset in FIG. 1;

DETAILED DESCRIPTION

Embodiments of the present invention are described herein. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The inventions below are described in terms of a "headset," which is a device commonly understood to include one or more headphones coupled with a microphone for allowing two-way communications. For purposes of this disclosure, however, and as will be readily appreciated by those of ordinary skill in the art, the novel aspects of the present invention are applicable to any type of sound delivery device that operates to position one or more headphones next to a user's ear or ears. In other words, while the inventions described herein are applicable to headsets used for two-way communications, they are also applicable to one or more headphones that are not equipped for two-way communications, but are rather used solely for listening to music or other audio waveforms.

Figure 1:
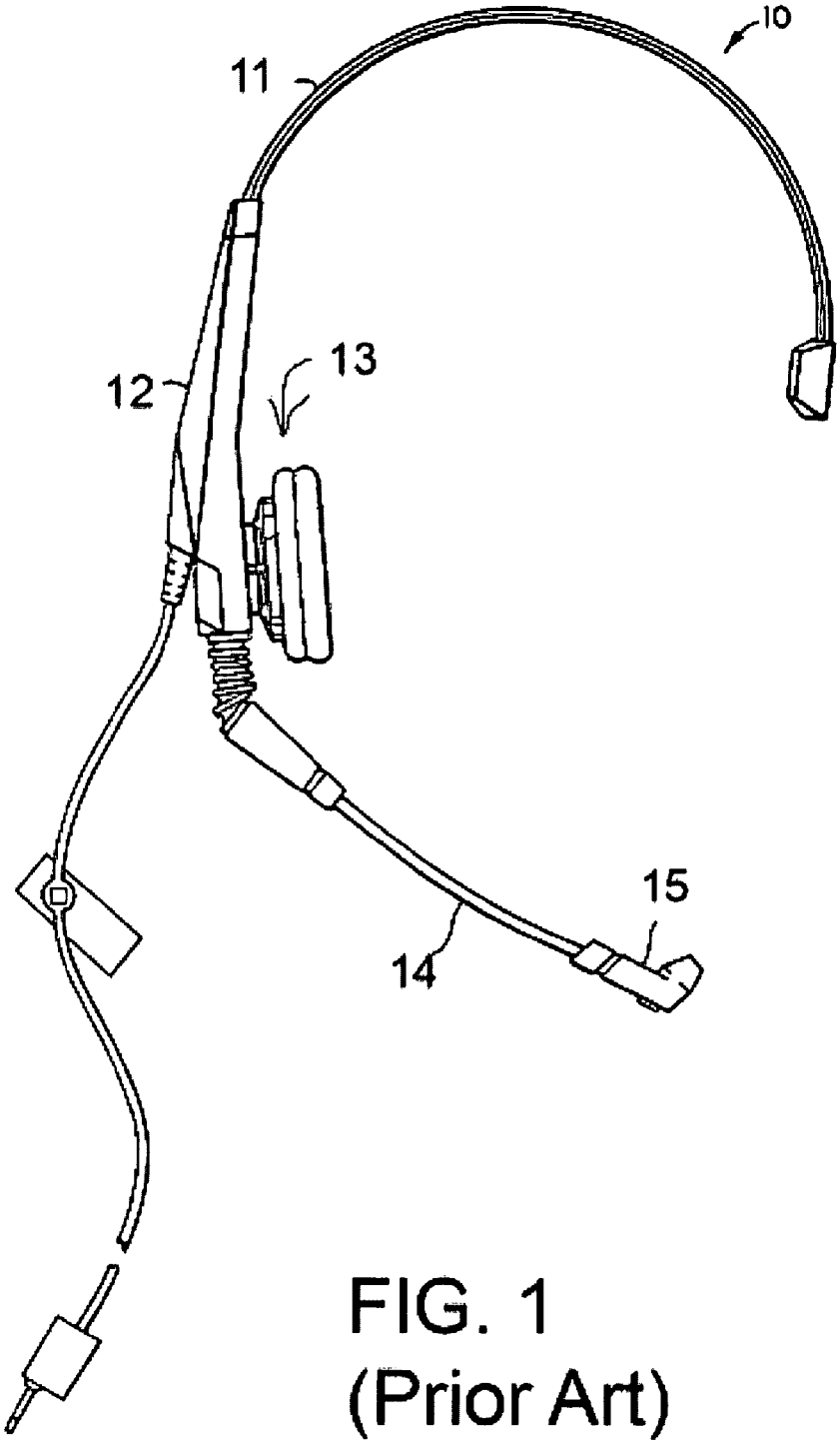
FIG. 1 (Prior Art)
FIG. 1 is a drawing of a conventional headset.
Figures 2, 2A:
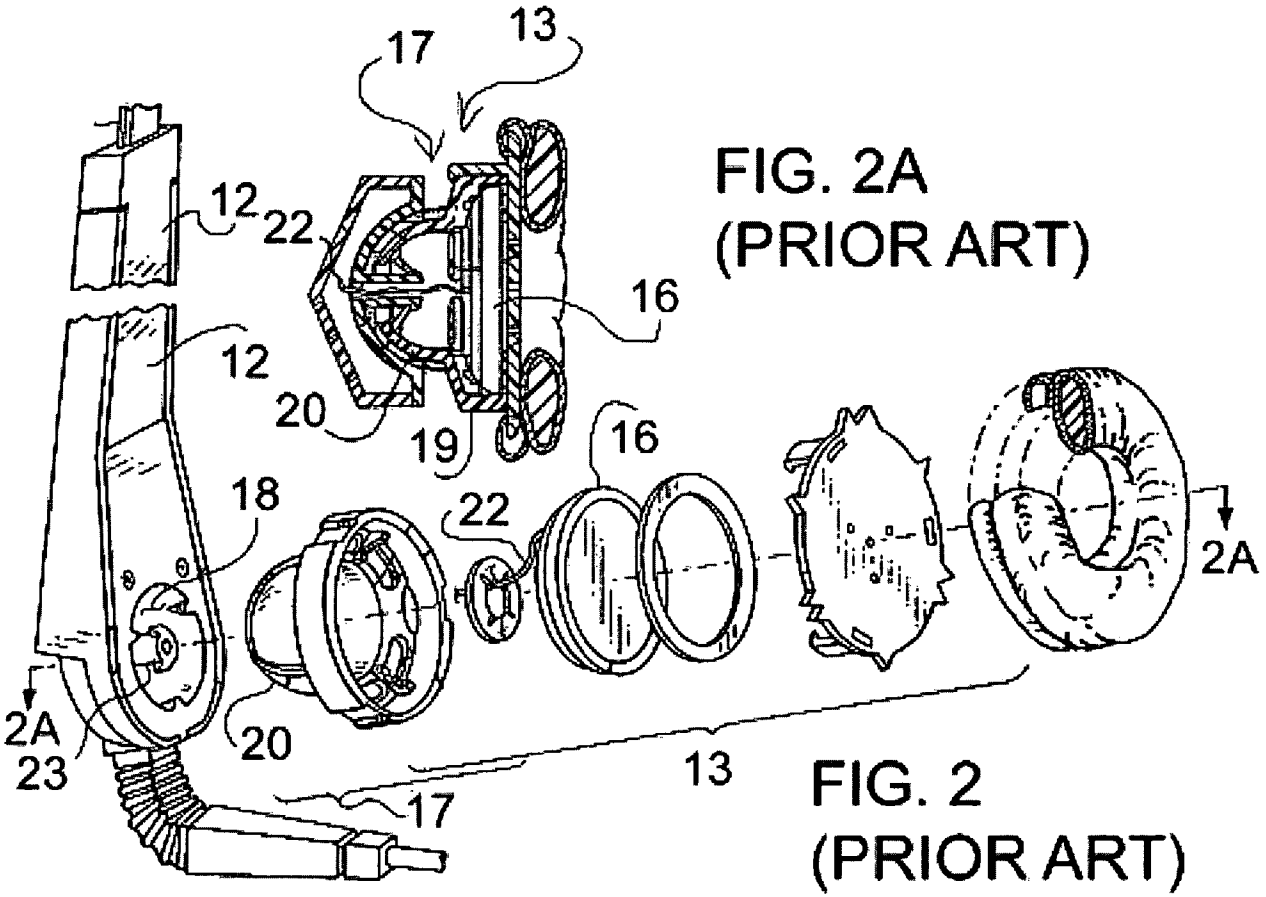
FIG. 2A (PRIOR ART)
FIG. 2 (PRIOR ART)
Figure 3:
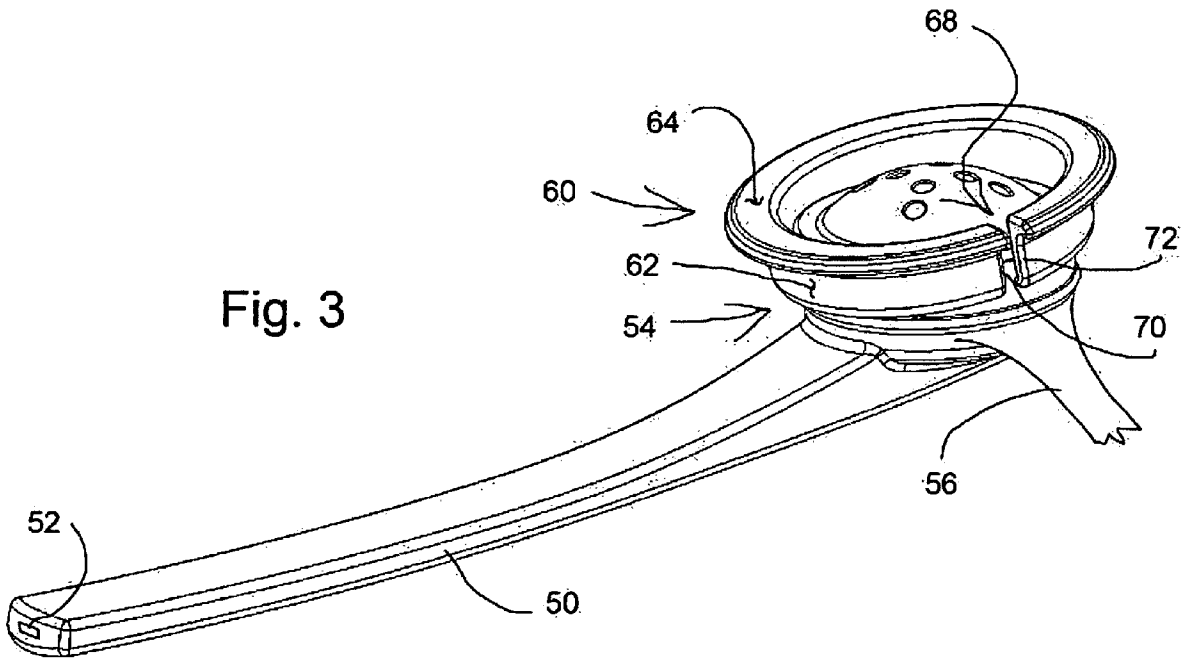
FIG. 3 is an isometric drawing of a portion of a headset having a rotatable earpiece, in accordance with an embodiment of the present invention.
Figure 4:
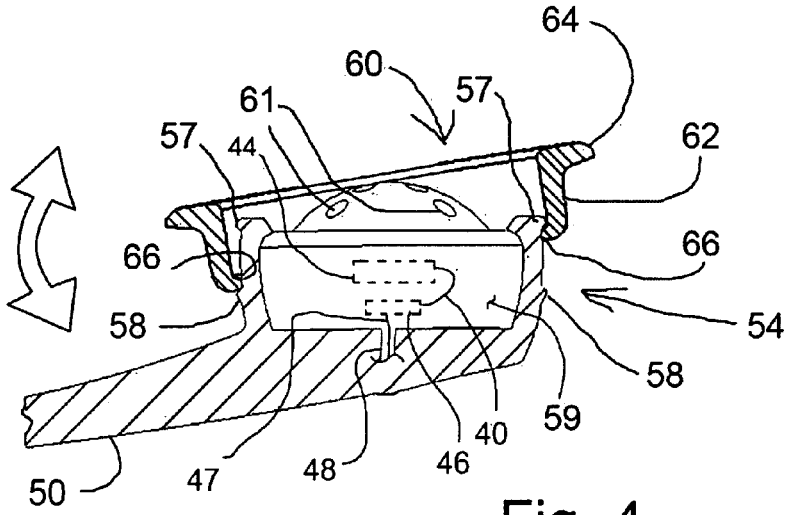
FIG. 4 is a partial cross-sectional drawing of the headset in FIG. 3.
Figure 5:
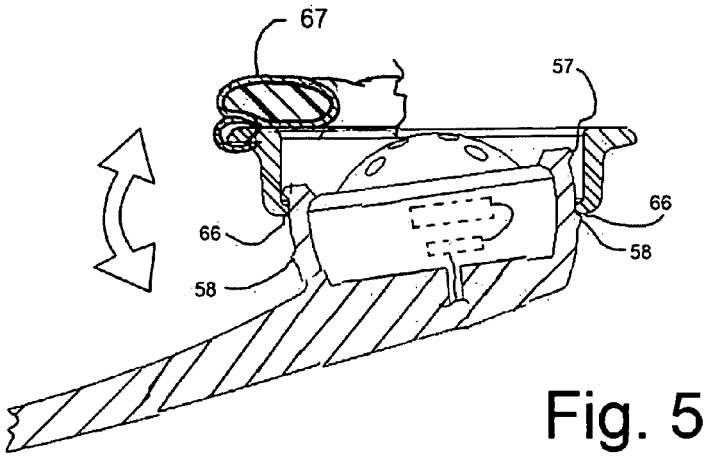
FIG. 5 a partial cross-sectional drawing of the headset in FIG. 3, similar to the illustration in FIG. 4, but with the earpiece of the headset in a different position.

Turning now to FIG. 3-5, there is shown a headset having a rotatable earpiece, according to an embodiment of the present invention. The headset includes a boom 50, which has a microphone 52 connected in one end, and at the opposite end of the boom 50 a joint 54 is connected. A headband 56 is connected to the joint 54, and it should be understood that only a portion of the headband 56 is shown for the purpose of clarity. It should also be understood that instead of headband 56 other means can be provided for securing the device adjacent the user's ear. For example, a conventional ear loop can be used to hook over the user's ear.

The outside of the joint 54 includes a first rib 57, which extends around the upper periphery of the joint 54, and a second rib 58, which extends around the joint 54 and is spaced apart from the first rib 57. The external surface of the joint 54 between the first rib 57 and the second rib 58 is shaped in the form of a section of a sphere.

Inside the joint 54 a speaker assembly 59 is mounted. The speaker assembly 59 includes ports 61 to permit sound from a speaker 44 to exit from the speaker assembly 59 toward the user's ear. Electrical wiring 40 is connected to the speaker 44, and the electrical wiring 40 may be connected to an electronic processing system 46, which can be a printed circuit board, for example. The electronic processing system 46 may or may not receive and process signals from the microphone 15, and the electronic processing system 46 is conventional and will therefore not be discussed in detail herein. The electrical wiring 40 may be connected directly to a signal and power source. Electrical wiring 47 may be connected to the electronic processing system 46, and the electrical wiring 40 and/or 47 may pass through a hole 48 formed in the joint 54 or boom 50 to be connected to a signal and power source such as a computer or telephone system. The electronic processing system 46 may also be wireless and may or may not transmit to an external signal source. The electrical wiring 40 and 47 can be affixed to speaker assembly 59 or elsewhere to be maintained in a fixed position relative to the boom 50.

An earpiece 60 is mounted to the joint 54, and the earpiece 60 includes a cylindrical section 62, which surrounds a portion of the joint 54. The earpiece 60 also includes a flange 64 mounted to one side of the cylindrical section 62, and an earpiece rib 66 is located around the periphery of the bottom of the cylindrical section 62. A conventional ear cushion 67, which is only partially shown, is mounted to the flange 64. Alternatively, the earpiece and ear cushion may be the same part.

The earpiece 60 is substantially circular, except that the earpiece 60 includes a slot 68 so that the earpiece 60 has a first end 70 to one side of the slot 68 and a second end 72 located to the other side of the slot 68. The earpiece 60 is formed of resilient material such as rubber or plastic and thus it can be seen that to install the earpiece 60 around the joint 54 and remove the earpiece 60 from the joint 54, the earpiece can be deformed by moving the first end 70 away from the second end 72. After the separating force is released the earpiece resumes the configuration it had before deformation. Alternatively, the earpiece 60 can be formed of a material which is sufficiently flexible so that the slot 68 can be unnecessary and the earpiece can be stretched to install it on the joint 54.

The operation of the device can now be understood. When a user places the headset on his or her head, the ear cushion 67 abuts the side of the user's head and the user's ear. At this time the earpiece 60 can move, as indicated by the arrow (see FIG. 5), to a variety of orientations with respect to the joint 54, which are schematically represented by FIG. 4 at one extreme and FIG. 5 at the opposite extreme. It should be understood that the joint 54 can be considered to have a point of rotation which is coincident with the center of the spherical portion of the joint, and the earpiece 60 essentially rotates about the point of rotation.

The earpiece rib 66 is sized so that it can move in frictional engagement against the joint 54 with moderate force required to move the earpiece, and the range of motion of the earpiece is limited by the interaction of earpiece rib 66 with ribs 57 and 58. It should be understood that FIGS. 4 and 5 illustrate the movement of the earpiece 60 in only two dimensions, although the earpiece can, in fact, move in three dimensions. Thus, depending on the position of the headset with respect to the user's head and ear, the earpiece 60 will assume an appropriate position.

It should now be appreciated that although the earpiece 60 moves relative to the boom 50, the speaker assembly 59 and the speaker 44 remain stationary relative to the boom 50. Accordingly, the electrical wiring 40 to the speaker 44 does not flex as the earpiece 60 moves, and therefore the longevity of the electrical wiring is enhanced. Another advantage is that in certain applications the user can adjust the position of the boom and microphone relative to the user's mouth without uncoupling the ear cushion 67.

Figure 6:
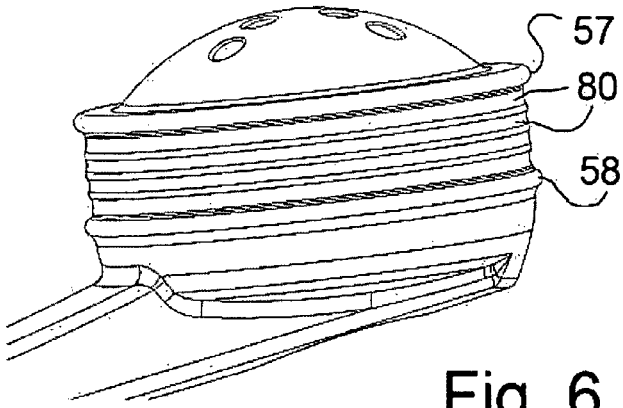
FIG. 6 is a drawing of a headset having a rotatable earpiece, in accordance with another embodiment of the present invention.
Figure 7:
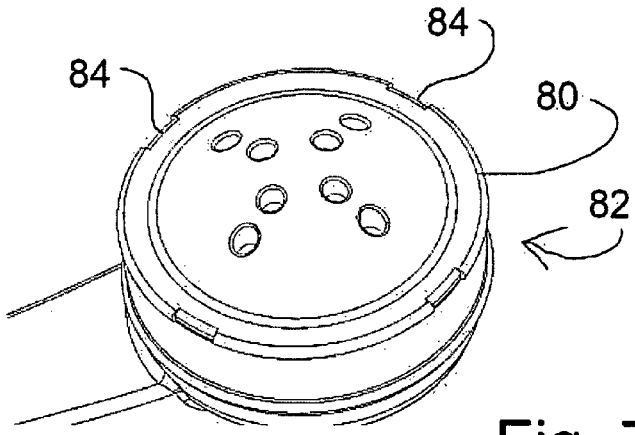
FIG. 7 is a drawing of a headset having a rotatable earpiece, in accordance with another embodiment of the present invention.

Turning now to FIGS. 6 and 7, alternative embodiments are shown. In FIG. 6, a plurality of grooves 80 are formed around the joint 54. The circumference of the earpiece rib 66 is correctly sized so that the raised elements between the grooves 80 act as detents with respect to the earpiece rib 66. Thus the position of the earpiece 60 can be changed in increments.

In the embodiment of FIG. 7, the upper rib 80 of the joint 82 includes a plurality of keyways 84. An earpiece, not shown, includes a plurality of keys which correspond to the keyways 84. Thus the earpiece can be installed and de-installed by rotation to the proper position so that the keys match the keyways 84. In this embodiment the earpiece 60 is formed of a relatively inflexible material.

In another alternative embodiment, the earpiece includes two ribs while the joint includes a single rib. The single rib of the joint is located between the two ribs of the earpiece to permit substantially the same movement as illustrated in FIGS. 4 and 5.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A sound delivery device comprising:

a speaker;

securing means, coupled to the speaker, for securing said speaker adjacent a user's ear; and an earpiece, rotatably coupled to the securing means, movable with respect to said speaker.

2. The sound delivery device according to claim 1, further comprising a joint, wherein said joint is coupled to said securing means.

3. A sound delivery device according to claim 2 wherein said speaker is rigidly coupled to said joint.

4. The sound delivery device according to claim 2 wherein said earpiece is movably coupled to said joint.

5. The sound delivery device according to claim 4 wherein said joint has a point of rotation and said earpiece is rotatable about the point of rotation.

6. The sound delivery device according to claim 5 wherein said earpiece is rotatable about the point of rotation in three dimensions.

7. A sound delivery device comprising:

a speaker;

a joint coupled to said speaker, the joint comprising a first surface and an earpiece, movably coupled to said joint, the earpiece comprising an engagement surface configure to move in frictional engagement with the first surface and wherein said earpiece is movable with respect to said speaker.

8. The sound delivery device according to claim 7 wherein said first surface comprises a spherical section having a point of rotation and said earpiece is rotatable about the point of rotation.

9. The sound delivery device according to claim 8 wherein said earpiece is rotatable about the point of rotation in three dimensions.

10. The sound delivery device according to claim 7 wherein said earpiece is rotatable only within a limited the range of motion.

11. A headset comprising:

a boom having a first end and a second end;

a microphone located adjacent the first end of said boom, said boom comprising a joint located adjacent the second end of said boom, said joint comprising a spherical section shaped in the form of a section of a sphere, the spherical section having a point of rotation;

an earpiece moveably mounted to said joint, said earpiece comprising a cylindrical section to cooperate with said spherical section of said joint, and rotatable about the point of rotation; and wherein said joint comprises at least one rib to limit the range of motion of said earpiece with respect to said joint.

12. A headset according to claim 11, further comprising a speaker coupled to said joint.

13. The headset according to claim 11 wherein said cylindrical section of said earpiece comprises at least one rib to limit the range of motion of said earpiece with respect to said joint.

14. The headset according to claim 11 wherein said joint comprises two ribs and said cylindrical section of said earpiece comprises one rib located between the two ribs of said joint to limit the range of motion of said earpiece with respect to said joint.

15. The headset according to claim 11 wherein said joint comprises at least one groove to restrict the motion of said earpiece with respect to said joint.

* * * * *